US011258192B2

(12) United States Patent
Mason et al.

(10) Patent No.: US 11,258,192 B2
(45) Date of Patent: Feb. 22, 2022

(54) CONTACT ARRAY FOR ELECTRICAL CONNECTOR

(71) Applicant: TE Connectivity Services GmbH, Schaffhausen (CH)

(72) Inventors: Jeffery Walter Mason, North Attleboro, MA (US); Brian Patrick Costello, Scotts Valley, CA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/749,468

(22) Filed: Jan. 22, 2020

(65) Prior Publication Data

US 2021/0226361 A1 Jul. 22, 2021

(51) Int. Cl.
*H01R 12/57* (2011.01)
*H01R 13/514* (2006.01)
(Continued)

(52) U.S. Cl.
CPC ..... *H01R 12/57* (2013.01); *H01R 12/585* (2013.01); *H01R 13/2442* (2013.01); *H01R 13/514* (2013.01); *H01R 13/6471* (2013.01)

(58) Field of Classification Search
CPC .... H01R 43/24; H01R 12/724; H01R 13/514; H01R 13/6585; H01R 13/6587; H01R 2107/00; H01R 12/51; H01R 12/7041; H01R 12/716; H01R 12/737; H01R 13/025; H01R 13/193; H01R 13/2435; H01R 13/518; H01R 13/6598; H01R 13/6599; H01R 24/86; H01R 43/0256; H01R 43/205; H01R 4/02; H01R 12/585; H01R 12/707; H01R 12/714; H01R 12/721; H01R 12/79; H01R 13/111; H01R 13/405; H01R 13/512; H01R 13/516; H01R 13/6464; H01R 13/6581; H01R 13/7197; H01R 24/60;
(Continued)

(56) References Cited

U.S. PATENT DOCUMENTS 5,186,633 A * 2/1993 Mosser, III ..... H01R 12/57 439/79
7,438,596 B2 * 10/2008 Phillips ..... H01R 13/6582 439/607.01
(Continued)

FOREIGN PATENT DOCUMENTS

WO 2018226805 A1 12/2018

*Primary Examiner* — Truc T Nguyen

(57) ABSTRACT

A receptacle connector assembly includes a receptacle cage mounted to a circuit board having walls defining a cavity including a module channel that receives a pluggable module. The receptacle connector assembly includes a communication connector received in the cavity and mounted to the circuit board. The communication connector has a housing holding a contact array including ground and signal contacts extending between mating and mounting ends of the housing. The ground contacts have ground mating ends and ground mounting ends including compliant pins press-fit into plated vias of the circuit board. The signal contacts have signal mating ends and signal mounting ends including deflectable spring beams deflected against the circuit board when the communication connector is mounted to the circuit board.

15 Claims, 6 Drawing Sheets

(51) Int. Cl.
*H01R 13/6471* (2011.01)
*H01R 13/24* (2006.01)
*H01R 12/58* (2011.01)

(58) Field of Classification Search
CPC ..... H01R 24/62; H01R 25/006; H01R 27/00; H01R 27/02; H01R 43/0221; H01R 43/16; H01R 43/20; H01R 4/025
See application file for complete search history.

(56) References Cited

U.S. PATENT DOCUMENTS 8,342,881 B2 * 1/2013 Lang ..... H01R 13/658 439/607.01
8,870,471 B2 * 10/2014 Ito ..... G02B 6/4269 385/92
9,136,650 B2 * 9/2015 Xuan ..... H01R 13/6586
9,246,252 B2 * 1/2016 Kachlic ..... H01R 13/6586
10,374,341 B1 * 8/2019 Phillips ..... H01R 12/721
2005/0255726 A1 * 11/2005 Long ..... H01R 13/6587 439/80
2006/0068640 A1 * 3/2006 Gailus ..... H01R 12/721 439/607.08
2009/0068887 A1 * 3/2009 Ito ..... H01R 12/00 439/607.05
2009/0311908 A1 * 12/2009 Fogg ..... H01R 13/6587 439/607.05
2011/0212632 A1 * 9/2011 Stokoe ..... H01R 12/721 439/83
2011/0294346 A1 * 12/2011 Davis ..... H01R 12/724 439/607.01
2013/0012038 A1 * 1/2013 Kirk ..... H01R 12/721 439/55
2013/0034994 A1 * 2/2013 Kuang ..... H01R 13/514 439/607.22
2015/0140861 A1 * 5/2015 Regnier ..... H01R 9/2458 439/607.1
2017/0271822 A1 * 9/2017 Zhang ..... H01R 12/7082
2018/0115098 A1 * 4/2018 Little ..... H01R 13/6582

* cited by examiner

CONTACT ARRAY FOR ELECTRICAL CONNECTOR

BACKGROUND OF THE INVENTION

The subject matter herein relates generally to contact arrays for electrical connectors.

Some communication systems utilize communication connectors to interconnect various components of the system for data communication. Some known communication systems use pluggable modules, such as I/O modules, that are electrically connected to the communication connector. Many conventional communication connectors are surface mount connectors having solder tails that are soldered to the circuit board. The solder tails are typically bent 90° to have a solderable surface. However, the conventional communication connectors are not without disadvantages. For instance, the solder tails are typically non-coplanar. The bottom surfaces of the solder tails are mis-aligned, leading to difficulties in soldering the solder tails to the circuit board. Some solder tails may be unsoldered, leading to failure of the communication connector.

A need remains for a communication system that may be assembled in a cost effective and reliable manner.

BRIEF DESCRIPTION OF THE INVENTION

In one embodiment, a receptacle connector assembly includes a receptacle cage configured to be mounted to a circuit board having walls defining a cavity including at least one module channel configured to receive a pluggable module. The receptacle connector assembly includes a communication connector received in the cavity configured to be mounted to the circuit board. The communication connector has a housing holding a contact array. The housing includes a mounting end facing the circuit board and a mating end configured to be mated with the pluggable module received in the module channel. The contact array includes ground contacts extending between the mating end of the housing and the mounting end of the housing having ground mating ends configured to be mated with the pluggable module and ground mounting ends configured to be terminated to the circuit board. The contact array includes signal contacts extending between the mating end of the housing and the mounting end of the housing having signal mating ends configured to be mated with the pluggable module and signal mounting ends configured to be terminated to the circuit board. The ground mounting ends include compliant pins configured to be press-fit into plated vias of the circuit board. The signal mounting ends include deflectable spring beams being deflected against the circuit board when the communication connector is mounted to the circuit board.

In an embodiment, a receptacle connector assembly is provided including receptacle cage configured to be mounted to a circuit board having walls defining a cavity including at least one module channel configured to receive a pluggable module. The receptacle connector assembly includes a communication connector received in the cavity configured to be mounted to the circuit board. The communication connector has a housing holding a contact array. The housing includes a mounting end facing the circuit board and a mating end configured to be mated with the pluggable module received in the module channel. The contact array includes ground contacts extending between the mating end of the housing and the mounting end of the housing having ground mating ends configured to be mated with the pluggable module and ground mounting ends configured to be terminated to the circuit board. The contact array includes signal contacts extending between the mating end of the housing and the mounting end of the housing having signal mating ends configured to be mated with the pluggable module and signal mounting ends configured to be terminated to the circuit board. The signal mounting ends include spring beams having deflectable arms and solder tails extending from the deflectable arms. The arms are deflected to a deflected state when the communication connector is mounted to the circuit board. The solder tails are configured to be soldered to solder pads of the circuit board with the arms in the deflected state.

In an embodiment, a communication connector is provided for a connector assembly including a housing extending between a mating end configured to be mated with a pluggable module and a mounting end configured to be mounted to a circuit board. The communication connector includes ground contacts extending between the mating end of the housing and the mounting end of the housing. The ground contacts have ground mating ends configured to be mated with the pluggable module. The ground contacts have ground mounting ends configured to be terminated to the circuit board. The communication connector includes signal contacts extending between the mating end of the housing and the mounting end of the housing. The signal contacts have signal mating ends configured to be mated with the pluggable module. The signal contacts have signal mounting ends configured to be terminated to the circuit board. The signal mounting ends include spring beams having deflectable arms and tails extending from the arms. The arms are deflected to a deflected state when the communication connector is mounted to the circuit board. The tails have contact interfaces configured to be electrically connected to circuit pads of the circuit board with the arms in the deflected state.

DETAILED DESCRIPTION OF THE INVENTION

Figure 1:
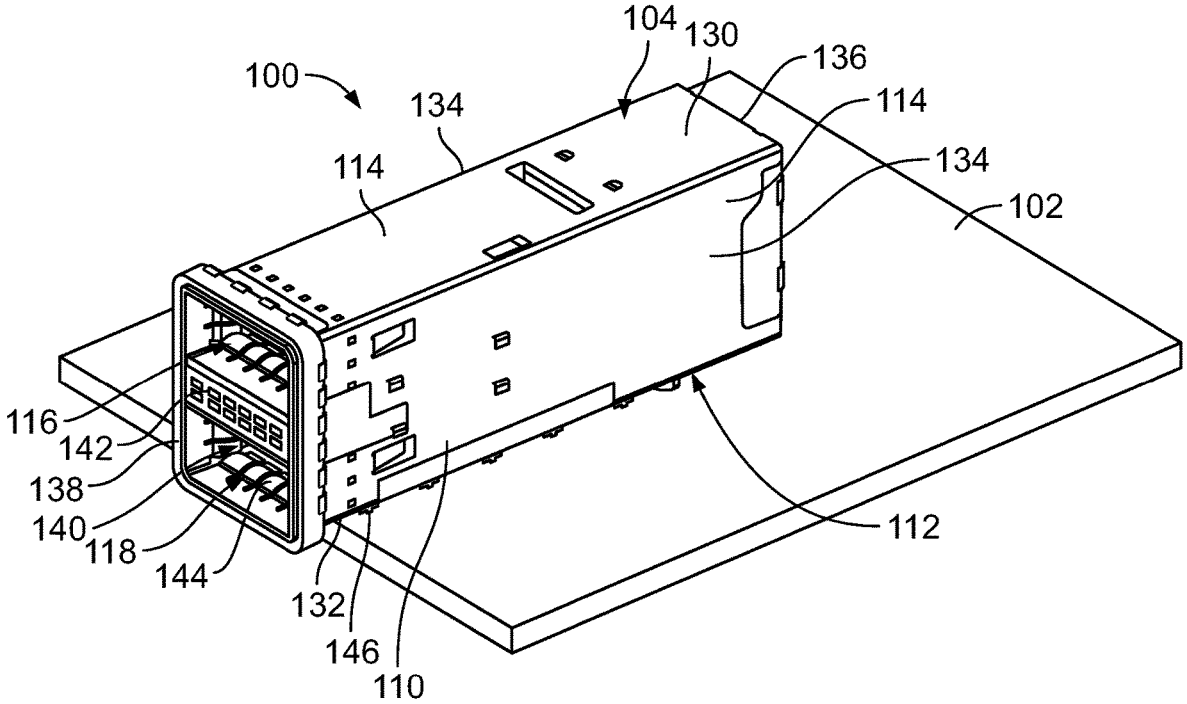
FIG. 1 is a front perspective view of a communication system formed in accordance with an exemplary embodiment.
Figure 2:
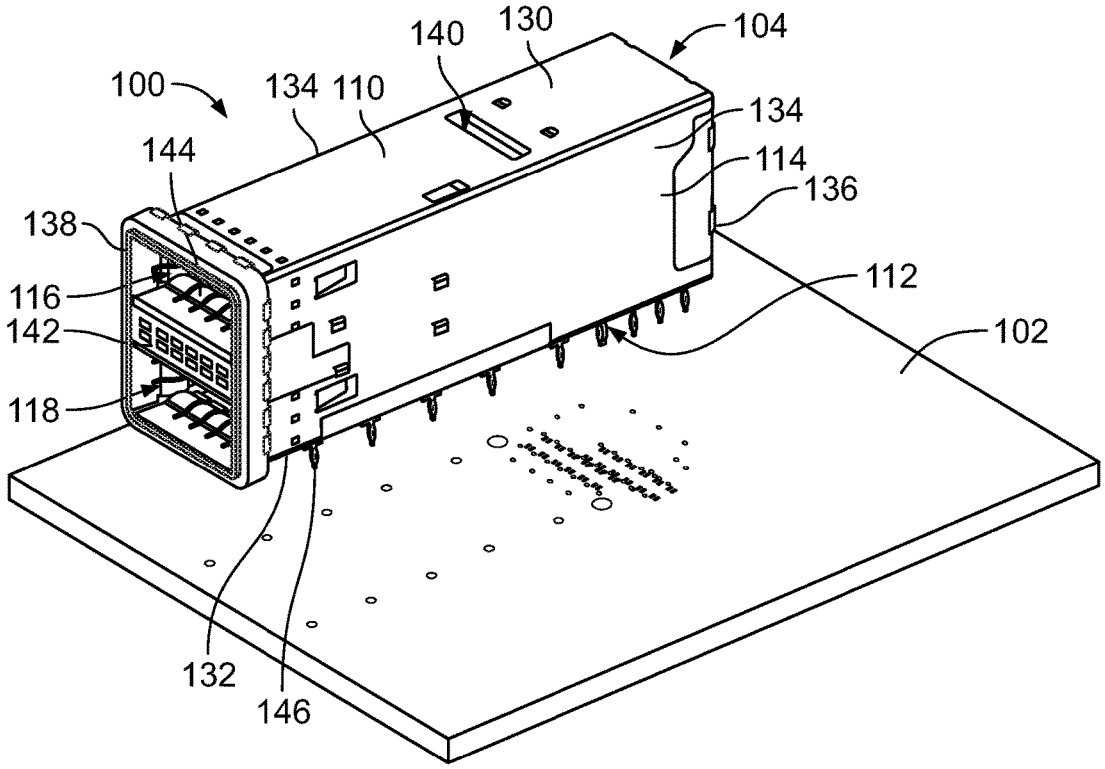
FIG. 2 is an exploded view of the communication system formed in accordance with an exemplary embodiment.

FIG. 1 is a front perspective view of a communication system 100 formed in accordance with an exemplary embodiment. FIG. 2 is an exploded view of the communication system 100 formed in accordance with an exemplary embodiment. The communication system 100 includes a circuit board 102 and a receptacle connector assembly 104 mounted to the circuit board 102. The receptacle connector assembly 104 is configured to receive one or more pluggable modules (not shown), such as an I/O transceiver module. The pluggable modules are electrically connected to the circuit board 102 through the receptacle connector assembly 104.

In an exemplary embodiment, the receptacle connector assembly 104 includes a receptacle cage 110 and a communication connector 112 (also shown in FIG. 4) adjacent the receptacle cage 110. For example, in the illustrated embodiment, the communication connector 112 is received in the receptacle cage 110. In other various embodiments, the communication connector 112 may be located rearward of the receptacle cage 110. In various embodiments, the receptacle cage 110 is enclosed and provides electrical shielding for the communication connector 112. When the pluggable modules are loaded into the receptacle cage 110, the pluggable modules are at least partially surrounded by the receptacle cage 110.

The receptacle cage 110 includes a plurality of walls 114 that define one or more module channels for receipt of corresponding pluggable modules. The walls 114 may be walls defined by solid sheets, perforated walls to allow airflow therethrough, walls with cutouts, such as for a heatsink or heat spreader to pass therethrough, or walls defined by rails or beams with relatively large openings, such as for airflow therethrough. In an exemplary embodiment, the receptacle cage 110 is a shielding, stamped and formed cage member with the walls 114 being shielding walls. In other embodiments, the receptacle cage 110 may be open between frame members, such as rails or beams, to provide cooling airflow for the pluggable modules with the frame members of the receptacle cage 110 defining guide tracks for guiding loading of the pluggable modules into the receptacle cage 110.

In the illustrated embodiment, the receptacle cage 110 constitutes a stacked cage member having an upper module channel 116 and a lower module channel 118. The receptacle cage 110 has module ports that open to the module channels 116, 118 that receive the pluggable modules. The receptacle connector assembly 104 is configured to mate with the pluggable modules in both stacked module channels 116, 118. Optionally, multiple communication connectors 104 may be arranged within the receptacle cage 110, such as when multiple columns of module channels 116, 118 are provided. Any number of module channels may be provided in various embodiments. In the illustrated embodiment, the receptacle cage 110 includes the upper and lower module channels 116, 118 arranged in a single column, however, the receptacle cage 110 may include multiple columns of ganged module channels 116, 118 in alternative embodiments (for example, 2×2, 3×2, 4×2, 4×3, etc.). In alternative embodiments, rather than being a stacked cage member, the receptacle cage 110 may include a single module channel or a single row of module channels.

In an exemplary embodiment, the walls 114 of the receptacle cage 110 include a top wall 130, a bottom wall 132, side walls 134, and a rear wall 136. The bottom wall 132 may rest on the circuit board 102. However, in alternative embodiments, the receptacle cage 110 may be provided without the bottom wall 132. The receptacle cage 110 extends to a front end 138. The module ports are provided at the front end 138. The walls 114 define a cavity 140. For example, the cavity 140 may be defined by the top wall 130, the bottom wall 132, the side walls 134, and the rear wall 136. Other walls 114 may separate or divide the cavity 140 into the various module channels 116, 118. For example, the walls 114 include a divider 142 between the upper and lower module channels 116, 118. The divider 142 forms a space between the upper and lower module channels 116, 118, such as for airflow, for routing light pipes, or for other purposes. In other various embodiments, the walls 114 may include vertical separator panels between ganged module channels 116 and/or 118.

In an exemplary embodiment, the receptacle cage 110 may include one or more gaskets 144 at the front end 138 for providing electrical shielding for the module channels 116, 118. For example, the gaskets 144 may be configured to electrically connect with the pluggable modules received in the corresponding module channels 116, 118. The gaskets 144 are configured to engage a panel (not shown) to electrically connect the receptacle cage 110 to the panel.

In an exemplary embodiment, the receptacle connector assembly 104 may include one or more heat sinks (not shown) for dissipating heat from the pluggable modules. For example, the heat sink may be coupled to the top wall 130 for engaging the pluggable module in the upper module channel 116. The heat sink may extend through an opening in the top wall 130 to directly engage the pluggable module. Other types of heat sinks may be provided in alternative embodiments.

In an exemplary embodiment, the communication connector 112 is received in the cavity 140, such as proximate to the rear wall 136. However, in alternative embodiments, the communication connector 112 may be located behind the rear wall 136 exterior of the receptacle cage 110 and extend through an opening in the rear wall 136 into the cavity 140 to interface with the pluggable module(s). In an exemplary embodiment, a single communication connector 112 is used to electrically connect with the pair of stacked pluggable modules in the upper and lower module channels 116, 118. In alternative embodiments, the communication system 100 may include discrete, stacked communication connectors 112 (for example, an upper communication connector and a lower communication connector) for mating with the corresponding pluggable modules.

The communication connector 112 is coupled to the circuit board 102. For example, the communication connector 112 may be surface mounted to the circuit board 102 in various embodiments. The communication connector 112 may be press-fit to the circuit board 102 in various embodiments. The communication connector 112 may be through hole soldered to the circuit board 102 in various embodiments. In an exemplary embodiment, the communication connector 112 has a compressive electrical interconnection mating interface for mating with the circuit board 102. For example, at least some of the contacts of the communication connector 112 may have deflectable spring beams that are compressible. The receptacle cage 110 is mounted to the circuit board 102 over the communication connector 112. In various embodiments, the receptacle cage 110 includes mounting pins 146 for mounting the receptacle cage 110 to the circuit board 102. For example, the mounting pins 146 may be press-fit pins. In other various embodiments, the mounting pins 146 may be solder pins. The mounting pins 146 may be used to hold the communication connector 112 with the contacts of the communication connector 112 in compressed states.

Figure 3:
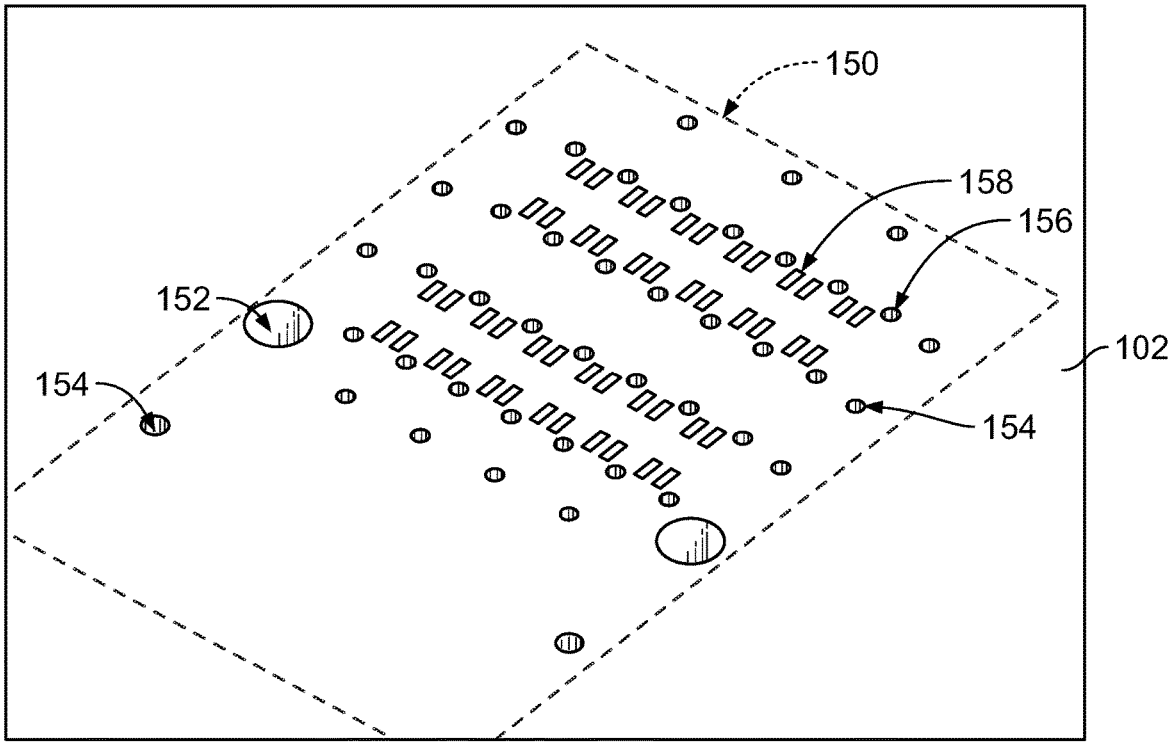
FIG. 3 is a perspective view of a portion of the communication system showing a portion of the circuit board in accordance with an exemplary embodiment.

FIG. 3 is a perspective view of a portion of the communication system 100 showing a portion of the circuit board 102 in accordance with an exemplary embodiment. The circuit board 102 includes a mounting area 150. The receptacle connector assembly 104 is mounted to the mounting area 150 of the circuit board 102. The circuit board 102 includes alignment openings 152 that receive alignment posts of the communication connector 112 to position the communication connector 112 relative to the circuit board 102. The circuit board 102 includes vias 154 that receive the mounting pins 146 of the receptacle cage 110 to align and secure the receptacle cage 110 to the circuit board 102.

The circuit board 102 includes signal conductors 158 configured to be electrically connected to signal contacts of the communication connector 112. In various embodiments, the signal conductors 158 are contact pads. The contact pads may be solder pads in various embodiments with the signal contacts of the communication connector 112 configured to be soldered to the contact pads. In other various embodiments, the contact pads may be contact wipe pads with the signal contacts of the communication connector 112 configured to wipe against the contact pads to define a separable mating interface. In other various embodiments, the signal conductors 156 may be plated vias.

The circuit board 102 includes ground conductors 156 configured to be electrically connected to ground contacts of the communication connector 112. In various embodiments, the ground conductors 156 are plated vias configured to receive compliant pins, such as press-fit pins. In other various embodiments, the ground conductors 156 may be contact pads. For example, the contact pads may be solder pads with the ground contacts of the communication connector 112 configured to be soldered to the contact pads. The contact pads may be contact wipe pads with the ground contacts of the communication connector 112 configured to wipe against the contact pads to define a separable mating interface. The communication connector 112 may include retention features, such as fasteners to position the communication connector 112 relative to the circuit board 102 for soldering the ground conductors 156 to the contact pads or compress the ground conductors 156 to the circuit board 102. In various embodiments, the communication connector 112 may include different types of ground conductors 156, such as both press-fit pins and solder tails.

Figure 4:
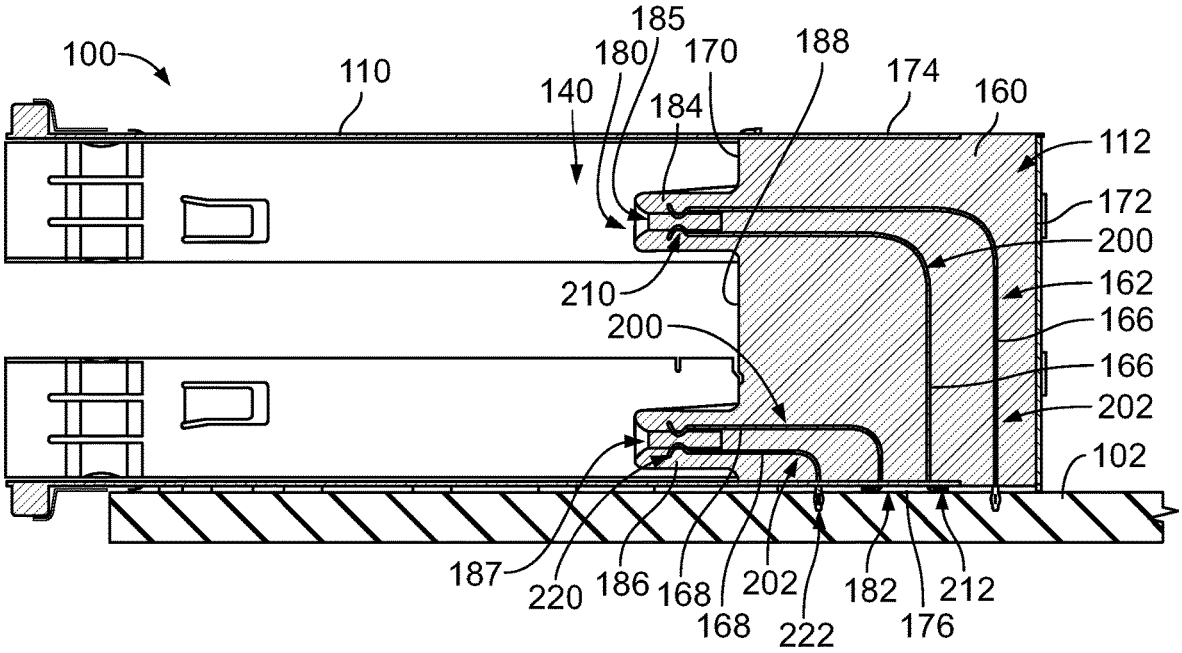
FIG. 4 is a cross sectional view of the communication system showing a communication connector in accordance with an exemplary embodiment.

FIG. 4 is a cross sectional view of the communication system 100 in accordance with an exemplary embodiment. The communication connector 112 is located within the cavity 140 of the receptacle cage 110. The communication connector 112 is shown mounted to the circuit board 102. The communication connector 112 includes a housing 160 holding a contact array 162. The contact array 162 includes a plurality of upper contacts 166 and a plurality of lower contacts 168. The upper contacts 166 may be arranged in multiple rows within the housing 160 and the lower contacts 168 may be arranged in multiple rows within the housing 160. The upper contacts 166 may include signal contacts and ground contacts. The lower contacts 168 may include signal contacts and ground contacts.

The housing 160 may be manufactured from a dielectric material, such as a plastic material. The housing 160 extends between a front 170 and a rear 172. The housing 160 has a top 174 and a bottom 176. In an exemplary embodiment, the front 170 defines a mating end 180 of the communication connector 112 and the bottom 176 defines a mounting end 182 of the communication connector 112. The mating end 180 is configured to be mated to the pluggable module(s). The mounting end 182 is configured to be mounted to the circuit board 102. The contacts of the contact array 162 extend between the mating end 180 and the mounting end 182.

In an exemplary embodiment, the housing 160 includes an upper extension 184 having an upper mating slot 185 configured to receive a portion of the pluggable module and a lower extension 186 having a lower mating slot 187 configured to receive a portion of the pluggable module. The upper contacts 166 are arranged in the upper mating slot 185 and the lower contacts 168 are arranged in the lower mating slot 187 for mating with the pluggable modules. The extensions 184, 186 extend forward of a front wall 188 at the front 170 of the housing 160. The mating slots 185, 187 define card slots configured to receive circuit cards of the pluggable modules. Other types of mating interfaces may be provided in alternative embodiments.

In an exemplary embodiment, the upper contacts 166 and the lower contacts 168 transition between the mating end 180 and the mounting end 182 to electrically connect the pluggable modules with the circuit board 102. The upper contacts 166 transition from the upper mating slot 185 to the bottom 176 for termination to the circuit board 102. The lower contacts 168 transition from the lower mating slot 187 to the bottom 176 for termination to the circuit board 102. In various embodiments, the contacts 166, 168 may be surface mounted to the circuit board 102 at a compressible mating interface. For example, the contacts 166, 168 may include spring beams that are deflected against the upper surface of the circuit board 102 when mounted thereto. In various embodiments, at least some of the contacts 166, 168 may be soldered to the circuit board 102. In various embodiments, at least some of the contacts 166, 168 may be press-fit into vias of the circuit board.

In an exemplary embodiment, the contact array 162 includes a plurality of signal contacts and a plurality of ground contacts. For example, the upper contacts 166 include both signal contacts 200 and ground contacts 202. The lower contacts 166 include both signal contacts 200 and ground contacts 202. The signal contacts 200 transition between the mating end 180 and the mounting end 182 to electrically connect the pluggable modules with the circuit board 102. Each signal contact 200 includes a mating end 210 and a mounting end 212. The mating end 210 is provided at the corresponding mating slot 185, 187. The mounting end 212 extends to the bottom 176 for termination to the circuit board 102. The ground contacts 202 transition between the mating end 180 and the mounting end 182 to electrically connect the pluggable modules with the circuit board 102. Each ground contact 202 includes a mating end 220 and a mounting end 222. The mating end 220 is provided at the corresponding mating slot 185, 187. The mounting end 222 extends to the bottom 176 for termination to the circuit board 102.

Figure 5:
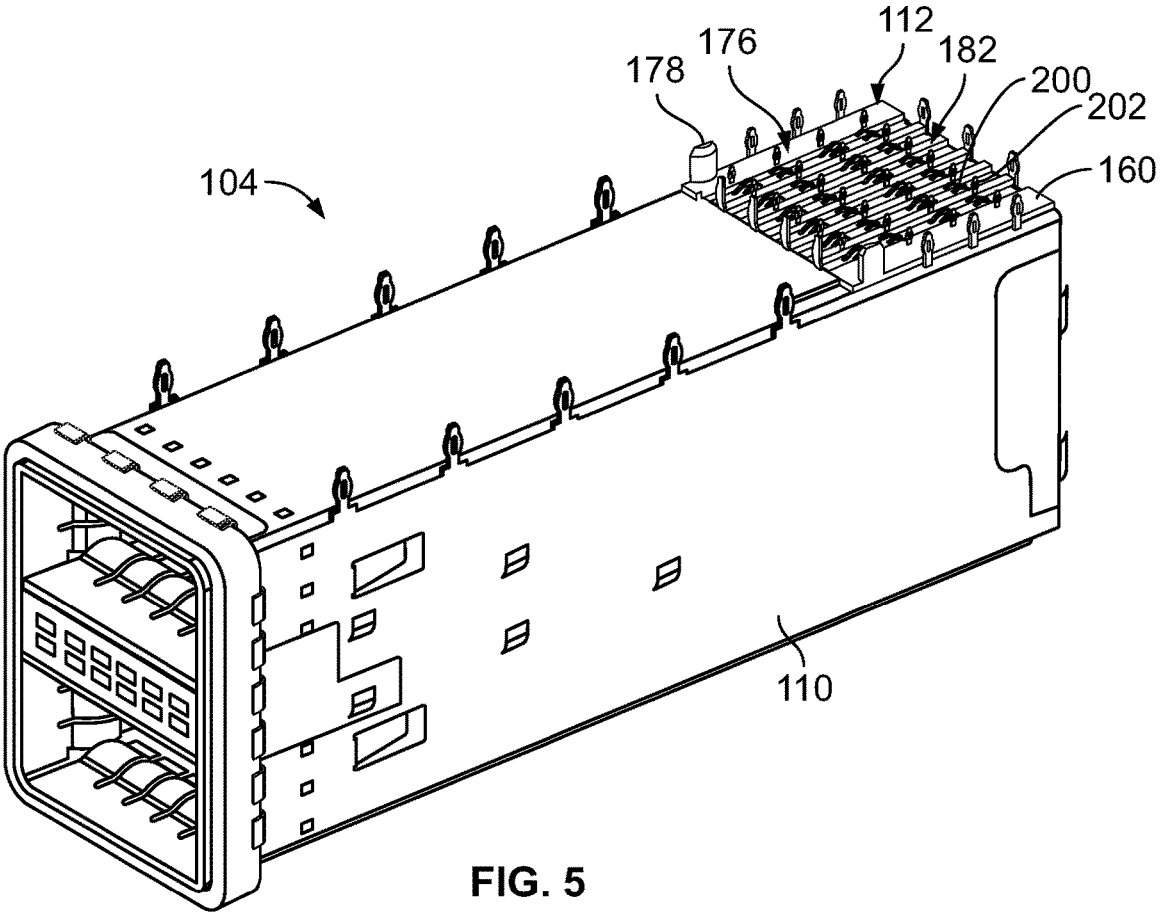
FIG. 5 is a bottom perspective view of the receptacle connector assembly showing the communication connector in accordance with an exemplary embodiment.
Figure 6:
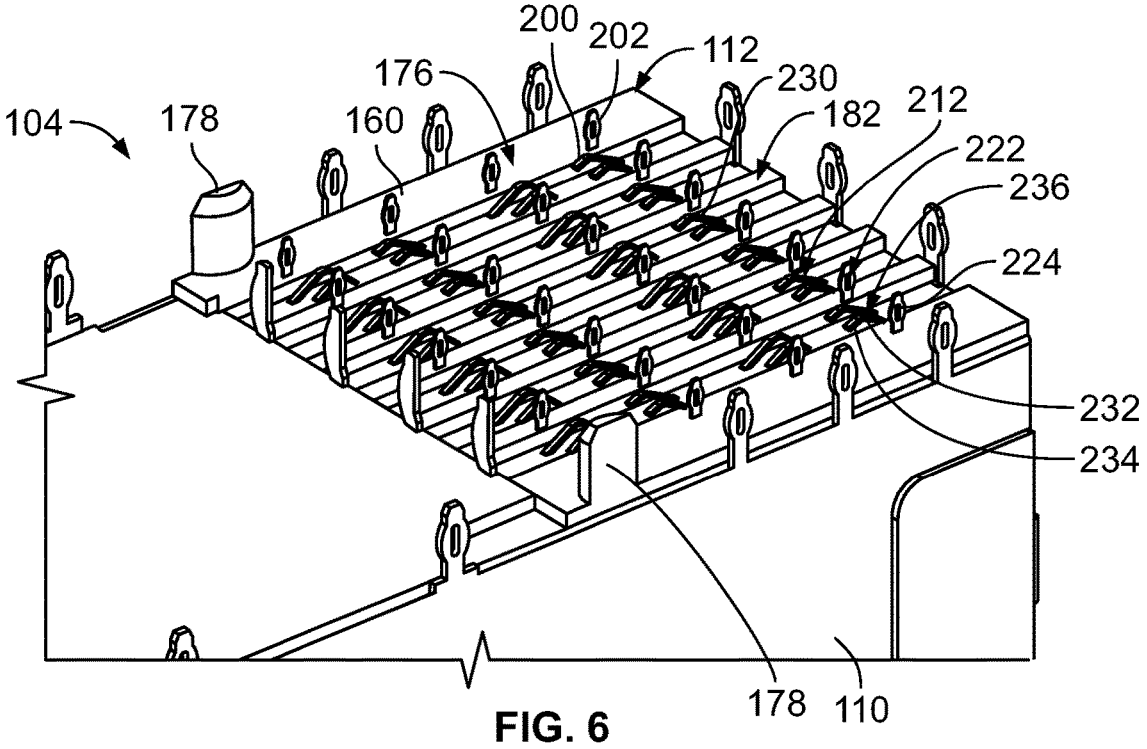
FIG. 6 is a bottom perspective view of a portion of the receptacle connector assembly showing the communication connector within a receptacle cage.

FIG. 5 is a bottom perspective view of the receptacle connector assembly 104 showing the communication connector 112 within the receptacle cage 110. FIG. 6 is a bottom perspective view of a portion of the receptacle connector assembly 104 showing the communication connector 112 within the receptacle cage 110. The mounting end 182 of the communication connector 112 is shown in FIGS. 5 and 6. The housing 160 includes alignment posts 178 extending from the bottom 176. The alignment posts 178 are configured to be received in corresponding alignment opening 152 (shown in FIG. 3) to align the communication connector 112 with the mounting area of the circuit board 102.

In an exemplary embodiment, the ground mounting ends 222 of the ground contacts 202 include compliant pins 224 configured to be press-fit into the plated vias 156 (shown in FIG. 3) of the circuit board 102. The compliant pins 224 may be eye-of-the-needle pins. In an exemplary embodiment, the compliant pins 224 provide retention forces to secure the communication connector 112 to the circuit board 102. For example, the compliant pins 224 may provide retention forces to compress the signal mounting ends 212 and deflect the signal mounting ends 212 against the circuit board 102.

In an exemplary embodiment, the signal mounting ends 212 of the signal contacts 200 include deflectable spring beams 230. The spring beams 230 are configured to be deflected against the circuit board 120 when the communication connector 112 is mounted to the circuit board 120. The spring beam 230 include an arm 232 and a tail 234 extending from the arm 232. The arm 232 extends at an angle relative to the bottom 176, such as approximately a 25° angle. The arm 232 is deflectable, such as to a deflected state, when the communication connector 112 is mounted to the circuit board 102. The angle of the arm 232 is reduced when the arm 232 is deflected. The arm 232 is configured to be elastically deformed when deflected to press the tail 234 outward against the circuit board 102. The arm 232 and the tail 234 may be compressed toward the bottom 176 of the housing 160 when the communication connector 112 is mounted to the circuit board 102. In an exemplary embodiment, a first subset of the signal mounting ends 212 extend forward and a second subset of the signal mounting ends 212 extend rearward. For example, some of the arms 232 may extend forward and some of the arms 232 may extend rearward. The spring beams 230 thus wipe in opposite directions on the circuit board 102 to cancel sideways forces during mating with the circuit board 102.

The tail 234 has a contact interface 236 configured to be electrically connected to the signal conductor 158 (for example, the circuit pad shown in FIG. 3) of the circuit board 102 with the arm 232 in the deflected state. The arm 232 creates an internal spring force to press the contact interface 236 outward into engagement with the circuit pad 158 of the circuit board 102. In an exemplary embodiment, the contact interface 236 is curved defining a separable contact interface configured to wipe along the circuit pad 158 as the arm 232 is deflected to the deflected state. In various embodiments, the tail 234 is a solder tail configured to be soldered to the circuit pad 158 of the circuit board 102. For example, the spring beam 230 may be compressed against the circuit board 102 and then soldered in place.

In an exemplary embodiment, the signal contacts 200 are arranged in pairs. The signal mounting ends 212 are arranged in pairs with the ground mounting ends 222 located between the pairs of signal mounting ends 212. The signal mounting ends 212 may be arranged in rows. For example, the signal mounting ends 212 associated with the upper contacts may be arranged in one or more rows and the signal mounting ends 212 associated with the lower contacts may be arranged in one or more rows. The ground mounting ends 222 may be arranged in the rows with the signal mounting ends 212.

Figure 7:
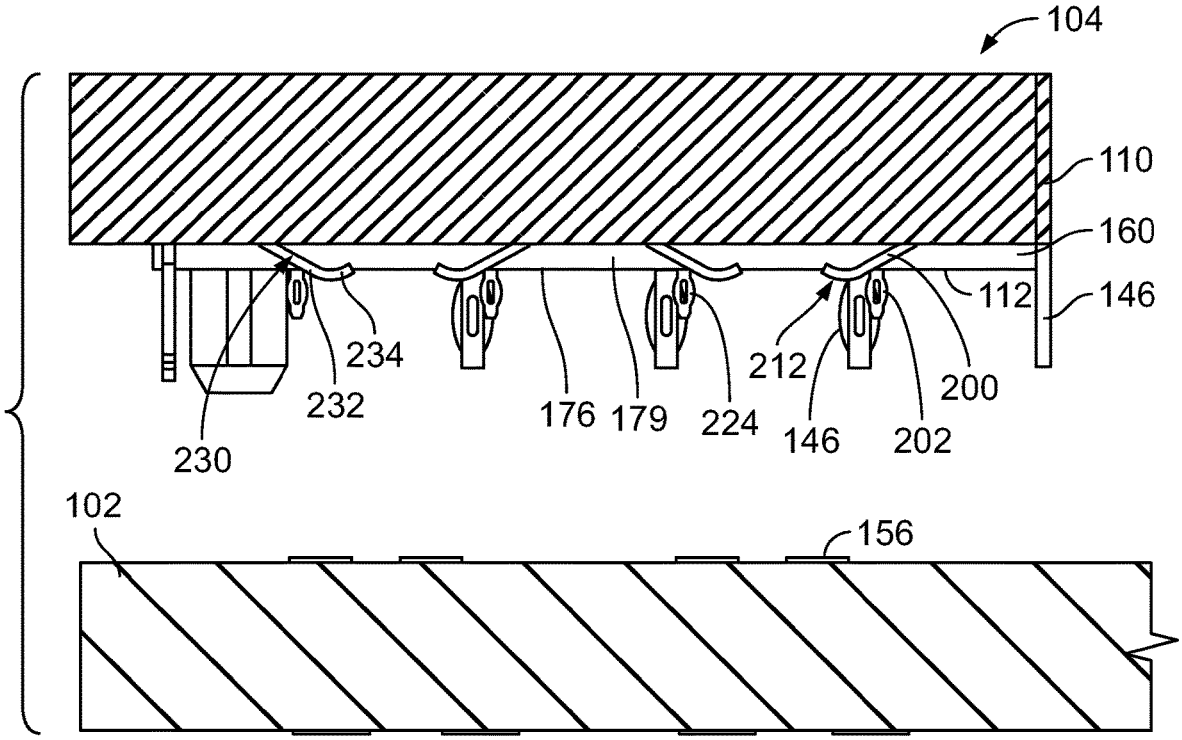
FIG. 7 is a side view of a portion of the receptacle connector assembly showing the communication connector poised for mounting to the circuit board.
Figure 8:
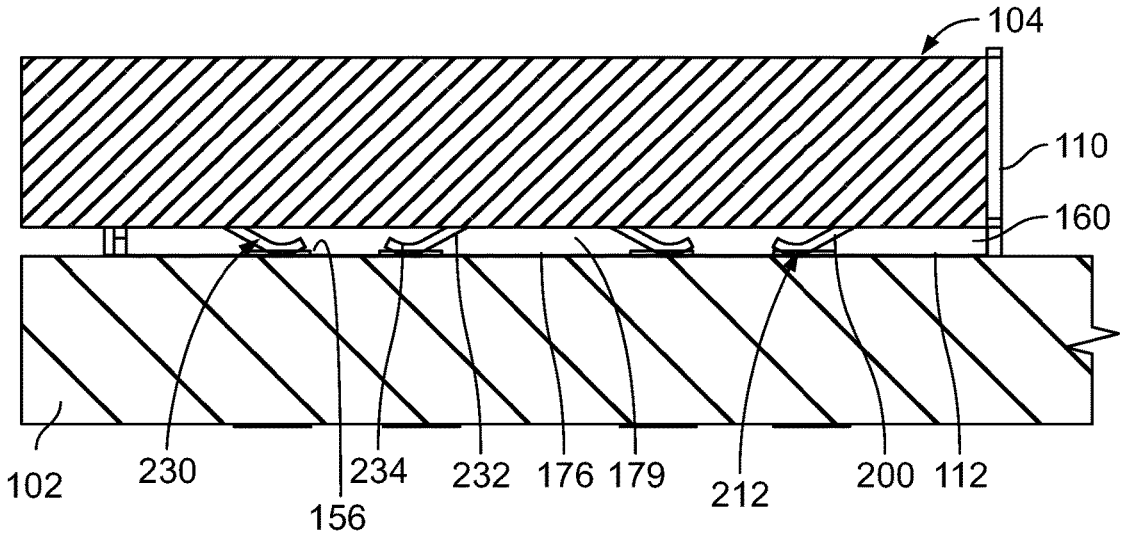
FIG. 8 is a side view of a portion of the receptacle connector assembly showing the communication connector mounted to the circuit board.

FIG. 7 is a side view of a portion of the receptacle connector assembly 104 showing the communication connector 112 poised for mounting to the circuit board 102. FIG. 8 is a side view of a portion of the receptacle connector assembly 104 showing the communication connector 112 mounted to the circuit board 102. During assembly, the communication connector 112 and the receptacle cage 110 are mounted to the upper surface of the circuit board 102.

The communication connector 112 has a compressive electrical interconnection mating interface for mating with the circuit board 102. For example, the signal mounting ends 212 of the signal contacts 200 include deflectable spring beams 230 that are compressible when mated with the circuit board 102. In the illustrated embodiment, the spring beams 230 extend in different directions (for example, some facing forward and some facing rearward). The spring beams 230 are deflectable toward the bottom 176 of the housing 160 of the communication connector 112. FIG. 7 illustrates the spring beams 230 in an undeflected state. FIG. 8 illustrates the spring beams 230 in a deflected state. The angles of the arms 232 of the spring beams 230 are less in the deflected state.

In an exemplary embodiment, the mounting pins 146 of the receptacle cage 110 may be used to press the communication connector 112 downward onto the circuit board 102. The mounting pins 146 may be used to hold the spring beams 230 of the signal contacts 200 in the compressed, deflected states. In an exemplary embodiment, the compliant pins 224 of the ground contacts 202 may be used to press the communication connector 112 downward onto the circuit board 102. The compliant pins 224 provide retention forces to secure the spring beams 230 to the circuit board 102 and maintain the electrical connection between the spring beams 230 and the contact pads 158 (shown in FIG. 3) of the circuit board 102. For example, the compliant pins 224 may provide retention forces to compress the spring beams 230 and deflect the arms 232 to hold the tails 234 against the circuit board 102. In an exemplary embodiment, the housing 160 includes a standoff 179 at the bottom 176 to position the housing 160 relative to the circuit board 102. The standoff 179 limits compression of the spring beams 230.

Figure 9:
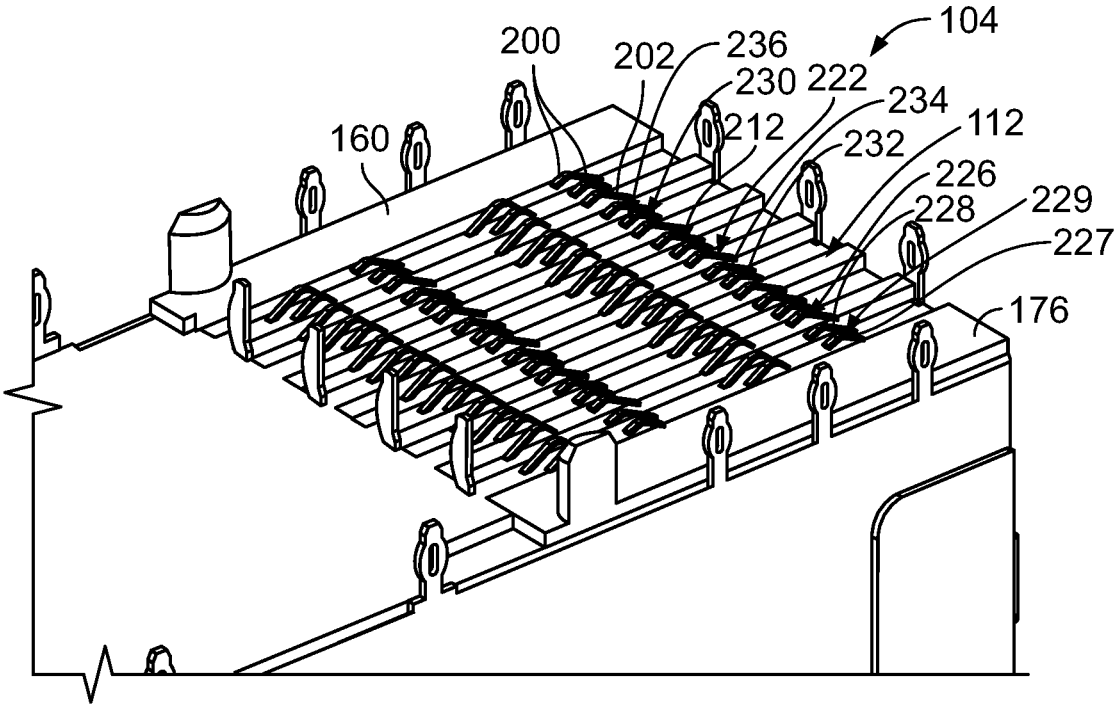
FIG. 9 is a bottom perspective view of a portion of the receptacle connector assembly showing the communication connector in accordance with an exemplary embodiment.

FIG. 9 is a bottom perspective view of a portion of the receptacle connector assembly 104 showing the communication connector 112 in accordance with an exemplary embodiment. In the illustrated embodiment, the contacts have an alternative mating interface including all compressible, deflectable mounting ends rather than some compliant pins as in the embodiment illustrated in FIG. 6.

In an exemplary embodiment, the ground mounting ends 222 of the ground contacts 202 include deflectable spring beams 226. The spring beams 226 are configured to be deflected against the circuit board 120 when the communication connector 112 is mounted to the circuit board 120. Each spring beam 226 includes an arm 227 and a tail 228 extending from the arm 227. The arm 227 extends at an angle relative to the bottom 176, such as approximately a 25° angle. The arm 227 is deflectable, such as to a deflected state, when the communication connector 112 is mounted to the circuit board 102. The angle of the arm 227 is reduced when the arm 227 is deflected. The arm 227 is configured to be elastically deformed when deflected to press the tail 228 outward against the circuit board 102. The arm 227 and the tail 228 may be compressed toward the bottom 176 of the housing 160 when the communication connector 112 is mounted to the circuit board 102. In an exemplary embodiment, a first subset of the ground mounting ends 222 extend forward and a second subset of the ground mounting ends 222 extend rearward. For example, some of the arms 227 may extend forward and some of the arms 227 may extend rearward.

The signal mounting ends 212 of the signal contacts 200 include the deflectable spring beams 230 having the arms 232 and the tails 234. In an exemplary embodiment, the signal mounting ends 212 are arranged in pairs with the ground mounting ends 222 located between the pairs of signal mounting ends 212. The mounting ends 212, 222 may be arranged in a plurality of rows. The tails 228, 234 have contact interfaces 229, 236, respectively, configured to be electrically connected to the circuit board 102. In an exemplary embodiment, the tails 228, 234 are solder tails configured to be soldered to the circuit board 102. For example, the solder tails 228, 234 are soldered to the circuit board 102 at the contact interfaces 229, 236.

Figure 10:
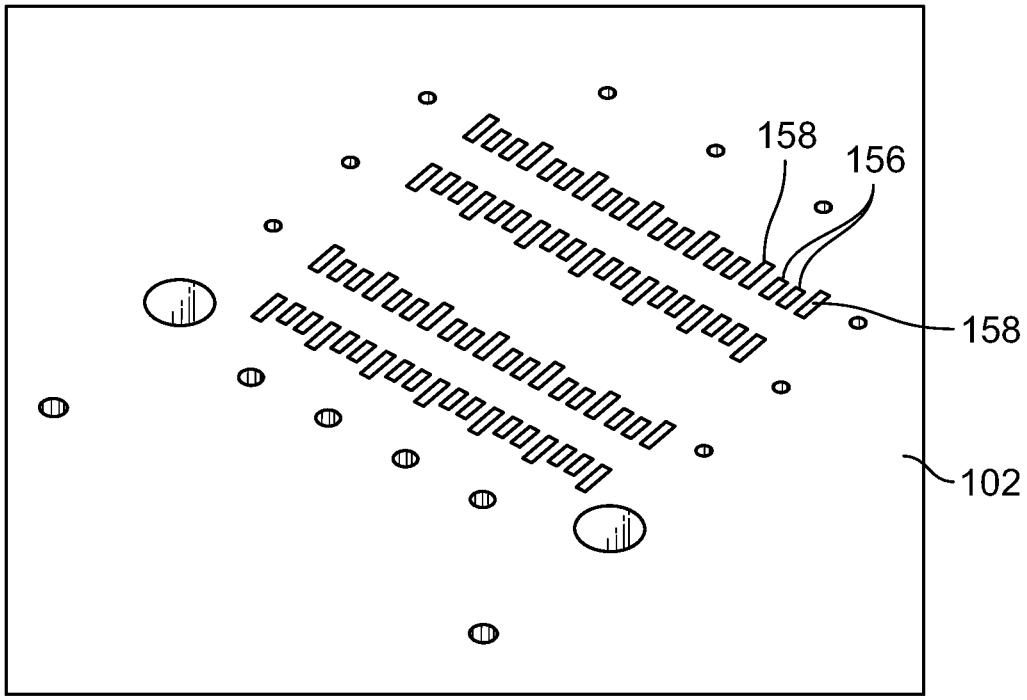
FIG. 10 illustrates the mounting area of the circuit board in accordance with an exemplary embodiment for receiving the communication connector shown in FIG. 9.

FIG. 10 illustrates the mounting area of the circuit board 102 in accordance with an exemplary embodiment for receiving the communication connector 112 shown in FIG. 9. The circuit board 102 includes the signal conductors 158 and the ground conductors 156. In the illustrated embodiment, the signal conductors 158 and the ground conductors 156 are contact pads. In various embodiments, the contact pads 158, 156 may be solder pads with the signal contacts 200 and the ground contacts 202 (both shown in FIG. 9) of the communication connector 112 configured to be soldered to the contact pads 158, 156, respectively. In other various embodiments, the contact pads 158, 156 may be contact wipe pads with the signal contacts 200 and the ground contacts 202 of the communication connector 112 configured to wipe against the contact pads to define a separable mating interface.

Figure 11:
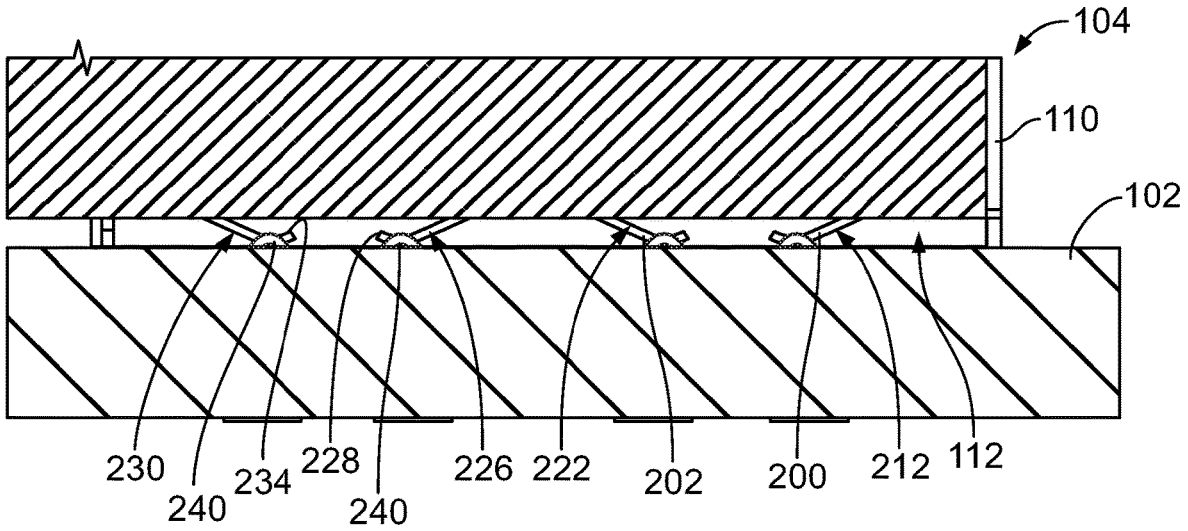
FIG. 11 is a side view of a portion of the receptacle connector assembly showing the communication connector mounted to the circuit board.

FIG. 11 is a side view of a portion of the receptacle connector assembly 104 showing the communication connector 112 mounted to the circuit board 102. During assembly, the communication connector 112 and the receptacle cage 110 are mounted to the upper surface of the circuit board 102. The communication connector 112 has a compressive electrical interconnection mating interface for mating with the circuit board 102. For example, the signal mounting ends 212 of the signal contacts 200 include the deflectable spring beams 230 that are compressible when mated with the circuit board 102 and the ground mounting ends 222 of the ground contacts 202 include the deflectable spring beams 226 that are compressible when mated with the circuit board 102. In an exemplary embodiment, the solder tails 228, 234 are configured to be soldered to the circuit board 102.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "second," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A receptacle connector assembly comprising:

a receptacle cage configured to be mounted to a circuit board, the receptacle cage having walls defining a cavity including at least one module channel configured to receive a pluggable module; and a communication connector configured to be mounted to the circuit board, the communication connector received in the cavity, the communication connector having a housing holding a contact array, the housing including a mounting end facing the circuit board, the housing including a mating end configured to be mated with the pluggable module received in the module channel, the contact array including ground contacts extending between the mating end of the housing and the mounting end of the housing, the ground contacts having ground mating ends configured to be mated with the pluggable module, the ground contacts having ground mounting ends configured to be terminated to the circuit board, the contact array including signal contacts extending between the mating end of the housing and the mounting end of the housing, the signal contacts having signal mating ends configured to be mated with the pluggable module, the signal contacts having signal mounting ends configured to be terminated to the circuit board, the signal mounting ends and the ground mounting ends being different types of mounting ends, wherein the ground mounting ends include compliant pins configured to be press-fit into plated vias of the circuit board, and wherein the signal mounting ends include deflectable spring beams, the spring beams being deflected against the circuit board when the communication connector is mounted to the circuit board, wherein each spring beam includes an arm and a tail extending from the arm, the arm being deflectable to a deflected state when the communication connector is mounted to the circuit board, the tail having a contact interface configured to be electrically connected to a circuit pad of the circuit board with the arm in the deflected state, the contact interface being curved defining a separable contact interface configured to wipe along the circuit pad as the arm is deflected to the deflected state.

2. The receptacle connector assembly of claim 1, wherein the signal mounting ends form a land grid array mating interface for the communication connector with the circuit board.

3. The receptacle connector assembly of claim 1, wherein the compliant pins provide retention forces to keep the spring beams deflected against the circuit board.

4. The receptacle connector assembly of claim 1, wherein a first subset of the signal mounting ends extend forward and a second subset of the signal mounting ends extend rearward.

5. The receptacle connector assembly of claim 1, wherein the signal contacts are arranged in pairs, the ground mounting ends being positioned between the pairs of the signal mounting ends.

6. The receptacle connector assembly of claim 1, wherein the receptacle cage includes mounting pins configured to be press-fit into the circuit board, the mounting pins provide retention forces to keep the spring beams deflected against the circuit board.

7. A receptacle connector assembly comprising:

a receptacle cage configured to be mounted to a circuit board, the receptacle cage having walls defining a cavity including at least one module channel configured to receive a pluggable module; and a communication connector configured to be mounted to the circuit board, the communication connector received in the cavity, the communication connector having a housing holding a contact array, the housing including a mounting end facing the circuit board, the housing including a mating end configured to be mated with the pluggable module received in the module channel, the contact array including ground contacts extending between the mating end of the housing and the mounting end of the housing, the ground contacts having ground mating ends configured to be mated with the pluggable module, the ground contacts having ground mounting ends configured to be terminated to the circuit board, the contact array including signal contacts extending between the mating end of the housing and the mounting end of the housing, the signal contacts having signal mating ends configured to be mated with the pluggable module, the signal contacts having signal mounting ends configured to be terminated to the circuit board, the signal mounting ends and the ground mounting ends being different types of mounting ends, the signal mounting ends include spring beams, the spring beams including deflectable arms and solder tails extending from the deflectable arms, the arms being deflected to a deflected state when the communication connector is mounted to the circuit board, the solder tails configured to be soldered to solder pads of the circuit board with the arms in the deflected state, wherein a first subset of the signal mounting ends extend forward and a second subset of the signal mounting ends extend rearward.

8. The receptacle connector assembly of claim 7, wherein the ground mounting ends include compliant pins configured to be press-fit into plated vias of the circuit board, the compliant pins providing retention forces to maintain the deflection of the arms and hold the spring beams against the circuit board.

9. The receptacle connector assembly of claim 7, wherein the signal mounting ends form a land grid array mating interface for the communication connector with the circuit board.

10. The receptacle connector assembly of claim 7, wherein the signal contacts are arranged in pairs, the ground mounting ends being positioned between the pairs of the signal mounting ends.

11. The receptacle connector assembly of claim 7, wherein the receptacle cage includes mounting pins configured to be press-fit into the circuit board, the mounting pins provide retention forces to maintain the deflection of the spring beams against the circuit board.

12. A communication connector for a connector assembly comprising:

a housing extending between a mating end and a mounting end, the mounting end configured to be mounted to a circuit board, the mating end configured to be mated with a pluggable module;

ground contacts extending between the mating end of the housing and the mounting end of the housing, the ground contacts having ground mating ends configured to be mated with the pluggable module, the ground contacts having ground mounting ends configured to be terminated to the circuit board; and signal contacts extending between the mating end of the housing and the mounting end of the housing, the signal contacts having signal mating ends configured to be mated with the pluggable module, the signal contacts having signal mounting ends configured to be terminated to the circuit board, the signal mounting ends being different types of mounting ends than the ground mounting ends, the signal mounting ends include spring beams, the spring beams including deflectable arms and tails extending from the arms, the arms being deflected to a deflected state when the communication connector is mounted to the circuit board, the tails having contact interfaces configured to be electrically connected to circuit pads of the circuit board with the arms in the deflected state, the contact interfaces being curved defining separable contact interfaces configured to wipe along the circuit pads as the arms are deflected to the deflected state.

13. The communication connector of claim 12, wherein the ground mounting ends include compliant pins configured to be press-fit into plated vias of the circuit board, the compliant pins providing retention forces to maintain the deflection of the arms and hold the tails against the circuit board.

14. The communication connector of claim 12, wherein the signal mounting ends form a land grid array mating interface for the communication connector with the circuit board.

15. The communication connector of claim 12, wherein a first subset of the signal mounting ends extend forward and a second subset of the signal mounting ends extend rearward.

* * * * *